US006552645B2

(12) United States Patent
Kuczynski

(10) Patent No.: US 6,552,645 B2
(45) Date of Patent: Apr. 22, 2003

(54) BIMETALLIC ACTUATOR FOR ELECTRONIC COMPONENTS AND OTHER DEVICES

(76) Inventor: Robert A. Kuczynski, 520 Springfield Ave., Westfield, NJ (US) 07090

( * ) Notice: Subject to any disclaimer, the term of this patent is extended or adjusted under 35 U.S.C. 154(b) by 83 days.

(21) Appl. No.: 09/875,384

(22) Filed: Jun. 6, 2001

(65) Prior Publication Data

US 2002/0186118 A1 Dec. 12, 2002

(51) Int. Cl.[7] ..... H01H 71/16; H01H 71/08

(52) U.S. Cl. ..... 337/111; 337/379; 337/36; 337/57; 337/333

(58) Field of Search ..... 337/16, 36, 53, 337/57, 111, 333, 343, 379, 347; 29/622

(56) References Cited

U.S. PATENT DOCUMENTS

| | | | | | |
|---|---|---|---|---|---|
| 1,668,973 | A | * | 5/1928 | Mottlau | 337/365 |
| 2,425,717 | A | | 7/1947 | Bean | 200/138 |
| 2,503,008 | A | | 4/1950 | Taylor | 200/138 |
| 2,701,475 | A | * | 2/1955 | Readeker | 74/100.2 |
| 2,720,416 | A | * | 10/1955 | Raleigh | 337/111 |
| 2,828,385 | A | | 3/1958 | Malone | 200/113 |
| 3,107,282 | A | | 10/1963 | Desio et al. | 200/113 |
| 3,141,080 | A | | 7/1964 | Ege | 200/113 |
| 3,143,614 | A | | 8/1964 | Ege | 200/113 |
| 3,588,787 | A | * | 6/1971 | Kindell et al. | 439/434 |
| 4,335,368 | A | * | 6/1982 | Givler | 337/372 |
| 4,379,278 | A | | 4/1983 | Kuczynski | 337/91 |
| 4,458,231 | A | * | 7/1984 | Senor | 337/107 |
| 4,605,279 | A | * | 8/1986 | Mixon, Jr. | 439/880 |
| 4,803,455 | A | | 2/1989 | Kuczynski | 337/68 |
| 4,943,247 | A | * | 7/1990 | Wise | 439/883 |
| 5,808,539 | A | * | 9/1998 | White | 337/379 |
| 5,854,583 | A | * | 12/1998 | Falchetti | 337/290 |
| 5,939,970 | A | * | 8/1999 | Tsuji et al. | 337/343 |
| 6,404,322 | B1 | * | 6/2002 | Ruegsegger et al. | 337/416 |

FOREIGN PATENT DOCUMENTS

| | | | | |
|---|---|---|---|---|
| JP | 08222302 A | * | 8/1996 | H01R/11/11 |

* cited by examiner

*Primary Examiner*—Anatoly Vortman
(74) *Attorney, Agent, or Firm*—Lerner, David, Littenberg, Krumholz & Mentlik, LLP

(57) ABSTRACT

A calibrated bimetallic actuator has contoured areas having either raised or recessed generally annular shaped forms about the locations thereon where the actuator is affixed in assembled position on associated electronic components or other devices or where a contact is affixed to the actuator to prevent loss of calibration by restricting transfer of force stresses in the bimetallic actuator during manufacture and assembly thereof into the associated components or devices. The action of the contoured areas on the actuator enables fabrication and assembly of miniaturized electronic components using bimetallic actuators for use in many applications.

20 Claims, 7 Drawing Sheets

BIMETALLIC ACTUATOR FOR ELECTRONIC COMPONENTS AND OTHER DEVICES

BACKGROUND OF THE INVENTION

This invention relates generally to bimetallic plates used as actuators for electronic and other devices and more particularly to the modification and improvement of such bimetallic actuators to primarily prevent the bimetallic actuators from losing calibration by preventing the transfer of forces and stresses to the calibrated areas of the bimetallic actuator during manufacture and assembly of the various types of electronic and other devices in which such bimetallic actuators are used and also more particularly to the use of such improved bimetallic actuators to enable greater miniaturization to be achieved for various types of electronic components such as cycling, non-cycling or manually resettable circuit breakers using such improved bimetallic actuators.

The use of bimetallic actuators in electronic components such as circuit breakers is generally disclosed in the prior art. This is shown in U.S. Pat. Nos. 2,503,008; 2,828,385; 3,141,080; 3,143,614; 4,379,278 and 4,803,455.

Those skilled in the art know that in bimetallic actuators such as snap-acting or cantilevered types of such actuators, the response time for the critical operating condition to be met must be accurate for the given electronic component. Therefore, such bimetallic actuators are calibrated, within the tolerance standards, for the application in which the given electronic component will be used so the response time for the condition being monitored by the electronic component will at all times remain accurate.

One of the problems which affects the accuracy of the calibration for a given bimetallic actuator is that which occurs during manufacture and assembly of the bimetallic actuator into the associated electronic component or other device. The calibration characteristics of the bimetallic actuator can be materially altered due to force stresses transferred into the calibrated areas of the bimetallic actuator caused by the particular manufacturing procedures such as welding, riveting, crimping or spring loading, used when either affixing contacts onto or when affixing the bimetallic actuator into assembled position on the associated electronic component or other device.

If the calibration characteristics of the bimetallic actuator are materially altered, the accuracy, function and operation of the electronic component or other device in which the bimetallic actuator is used will be compromised and the device will be rendered unusable and unsalable for the particular rating for such electronic component or other device. Of even greater significance in the commercial marketplace is the fact that this problem becomes increasingly complex as the size, thickness and other required characteristics of the bimetallic actuator are reduced to obtain or manufacture smaller or miniaturized versions of existing electronic components or other devices or to create new designs of such electronic components or other devices which utilize such bimetallic actuators as the, or one of the, critical operating elements. The improved bimetallic actuator in accordance with the present invention provides means to overcome this problem and provides other benefits in the manufacture and operation of the electronic components or other devices in which they are used.

Thus, in one aspect of the present invention, a bimetallic actuator is prevented from losing or being thrown out of calibration during attachment of contacts onto the bimetallic actuator and/or during affixation of the bimetallic actuator into assembled position during the manufacture and assembly of electronic components, electrical systems and other devices using such bimetallic actuators, by drawing, stamping or molding a contoured area or areas such as a generally raised or recessed annular shape on a given bimetallic actuator about either or both the point where an operative contact is to be located on the bimetallic actuator or the point where the bimetallic actuator is to be affixed into assembled position on the electronic component or other device. The raised or recessed annular shaped area or areas are preferably formed so that at all points the annular area or areas lie inwardly of the edges of the bimetallic actuator. These contoured area or areas are shaped to increase the rigidity of these area or areas on the bimetallic actuator so that they become inert and thus prevent the transfer of forces or stresses caused by welding, riveting, crimping or spring loading during manufacturing and assembly of the electronic component or other device using such bimetallic actuator.

While reference is made to the contoured area or areas as raised or recessed annular shapes, it is not necessary that such raised or recessed annular shapes be circumferentially integral. Thus, the annular shape may encompass a plurality of closely spaced arcuate sections or circumferentially disposed indentations without departing from the scope of the present invention. Further, however, it will be equally clear to those skilled in the art that generally integral annular raised or recessed annular shapes are preferred as they are the most effective means for achieving the advantageous results of the present invention such as the reduction in size and the miniaturizing of electronic components using such bimetallic actuators.

It is also known that the prior art electronic components with bimetallic actuators such as circuit breakers generally are too large for many applications. This compels the user with such applications to sacrifice the desirable protection afforded by such circuit breakers.

This occurs in the electronic components and other devices using bimetallic actuators because the problems which alter the calibration of the bimetallic actuator become even more significant and complex, when efforts are made to reduce the size of or to miniaturize the electronic components or other devices, because corresponding changes must be made to the bimetallic actuator in size, thickness and the materials from which the bimetallic actuator is made to achieve the desired calibration for the given component or device. These changes to the bimetallic actuator place the calibrated areas of the bimetallic actuator closer to the areas where the stress forces arise during manufacture and assembly, and because of their proximity these forces can now travel more easily into the calibrated areas so that calibration is either lost or thrown off, rendering the associate electronic component or device unusable and unsalable in the commercial marketplace for the required conditions of operation.

Thus, in addition to the advantageous features that the modified and improved bimetallic actuator in accordance with the present invention may have for use in larger electronic components, electrical systems and other devices, in another aspect of the present invention, it has been found that the modified or improved bimetallic actuator is particularly suitable for use in and to provide miniature circuit breakers substantially smaller than the prior art devices, thereby making such components more practical and desirable for use in motor vehicles and other devices which require protection of the electrical components in their electrical systems or the electrical system itself where mandatory, preferred or desired size limitations are specified by the users of such protective devices.

Thus, it is another aspect of the present invention to provide improved miniature bimetallic actuated circuit breakers of the cycling, non-cycling and manually resettable types utilizing bimetallic actuators having means defining contoured areas, one of said contoured areas formed about the point of connection for permanently affixing the bimetallic actuator into assembled position on one of the current carrying members in the bimetallic actuated circuit breaker and optionally and selectively at least another of said contoured areas a spaced distance therefrom for connecting a contact member to the bimetallic actuator, said contact member generally disposed in assembled position for coaction with the other current conducting member in the circuit breaker during operation thereof.

The contoured areas may be defined by a raised or recessed annular shape or shapes formed by stamping or molding on the bimetallic actuator and act to prevent the transfer of forces to the calibrated portions of the bimetallic actuator which occur during the manufacture and assembly of the miniature bimetallic actuated circuit breakers, thereby preventing the bimetallic actuator from being thrown out of calibration. The raised or recessed annular area or areas achieve this result because they increase the rigidity at these locations on the given bimetallic actuator. In addition, these raised or recess annular area or areas provide piloting for various assembly operations, insure more uniform and favorable welding results, simplify and decrease the cost of manufacturing the circuit breaker and provide means for achieving greater miniaturization of the circuit breakers in which such bimetallic actuators are used.

SUMMARY OF THE INVENTION

Thus, the present invention pertains generally to a bimetallic actuator for use in electronic components and other devices having, at least one contoured area about any selected location that will transmit stress forces into the calibrated areas of the bimetallic actuator during manufacture or assembly of the bimetallic actuator in associated electronic components.

The present invention also pertains to a miniature bimetallic actuated circuit breaker for protecting components in a current carrying circuit from damage which comprises, a sized and shaped housing, a first current carrying member, a second current carrying member in spaced relation to said first current carrying member, a bimetallic actuator having, a connecting location for fixedly connecting the bimetallic actuator to said first current carrying member, and a location or point for connecting a contact means spaced from said connecting location, contact means to be connected to said bimetallic actuator and in connected position for operative engagement with said second current carrying member, a contoured area about at least one of said location for the connecting means and the point of connection for the contact means, said contoured area to prevent the transfer of stress forces into the calibrated areas of the bimetallic actuator whereby said bimetallic actuator will operate at the predetermined calibration and prevent damage to the miniature bimetallic circuit breaker and the current carrying circuit in which it is mounted.

Accordingly, it is an object of the present invention to provide an improved bimetallic actuator for use in electronic components and other devices in which the transfer of stress forces is prevented to insure that the calibration of the bimetallic actuator remains substantially constant.

It is another object of the present invention to provide an improved bimetallic actuator used in forming miniature circuit breakers of the cycling, non-cycling or manually resettable type for applications in which it is desirable to use a smaller circuit breaker than are presently commercially available.

It is another object of the present invention to provide an improved miniature circuit breaker which can be manufactured at a relatively low cost.

It is still another object of the present invention to provide an improved bimetallic actuator for use in an improved miniature circuit breaker where a generally contoured area or areas are formed about either or both of the points for connecting the bimetallic actuator in assembled position and the contact means on said bimetallic actuator to provide heat dissipation sinks and increase the rigidity in such area or areas so as to prevent distortion of said bimetallic actuator during welding, riveting, crimping or spring loading which would otherwise cause the actuator to be thrown out of calibration, thereby enabling electrical devices such as circuit breakers to be miniaturized to meet modern day miniaturization demands.

It is a still further object of the present invention to provide an improved bimetallic actuator for use in an improved miniature circuit breaker where a generally contoured area or areas such as raised or recessed annular area or areas are drawn, struck or molded about either or both of the points for the connection of the bimetallic actuators into assembled position for use or for the formation of the operative contact means on said bimetallic actuator, to increase rigidity of the actuator in such areas, and thereby protect the performance characteristics of electronic devices using such bimetallic actuators such as circuit breakers.

It is a further object of the present invention to provide an improved bimetallic actuator including at least one generally contoured area or areas having either a raised or recessed annular shape that serves as a pilot location means for consistently welding said bimetallic actuator onto a current carrying member.

It is a further object of the present invention to provide for generally contoured areas having either raised or recessed annular shapes on a bimetallic actuator for use in an improved miniature circuit breaker to create more favorable weld results and simplicity in manufacturing.

It is another object of the present invention to provide a bimetallic actuator with generally contoured annular members either raised or recessed about either or both the point of connection and the contact means on the bimetallic actuator to allow for non-invasive connection thereof to avoid changing the calibration of the bimetallic actuator during assembly, provide more efficient operation and allow for decreasing the physical size of a circuit breaker or other electronic component.

These and other objects of the present invention will be more clearly understood from the description when read in conjunction with the accompanying drawings.

DETAILED DESCRIPTION

Figure 1:
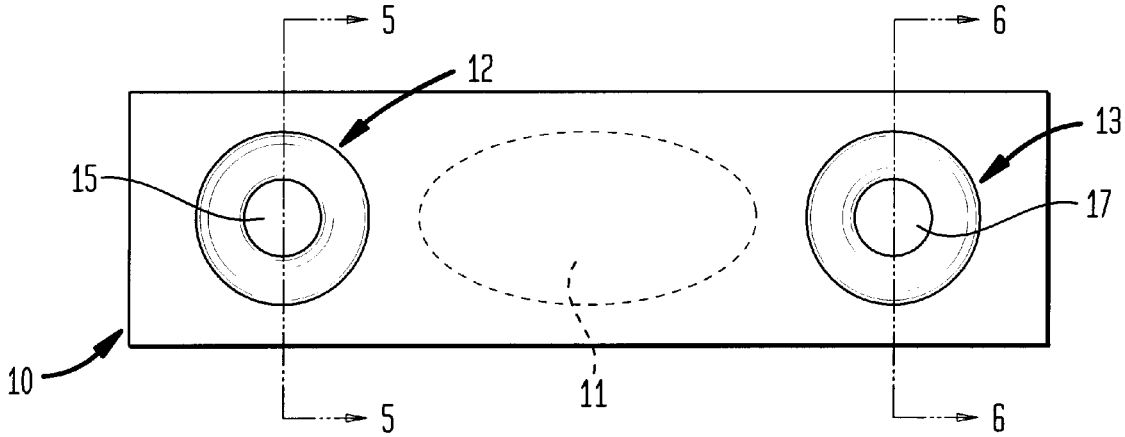
FIG. 1 is a top plan view of an enlarged bimetallic actuator in accordance with the present invention with a first contoured area about the point where a contact can be affixed to the bimetallic actuator and a second contoured area spaced from the first contoured area about the point where the bimetallic actuator is affixed in assembled position in an associated electronic component and a marked area where the bimetallic actuator is calibrated.
Figure 2:
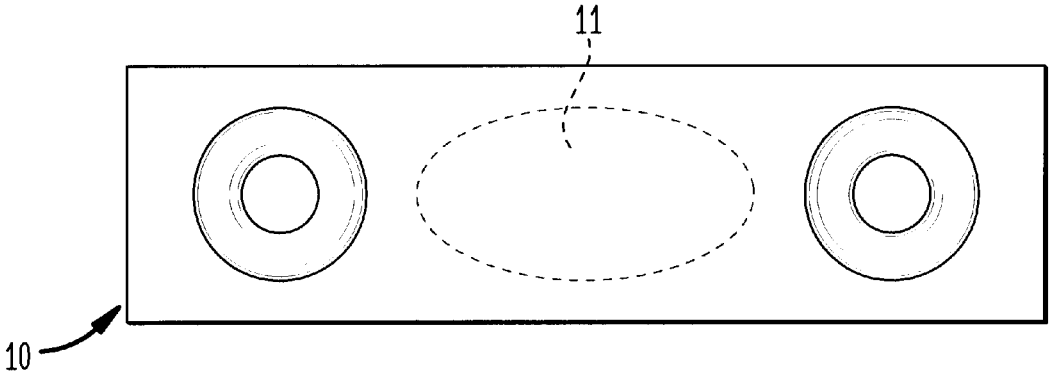
FIG. 2 is a bottom plan view of the bimetallic actuator shown in FIG. 1.
Figure 3:
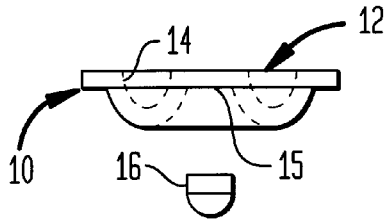
FIG. 3 is a left end view of the bimetallic actuator shown in FIG. 1.
Figure 4:
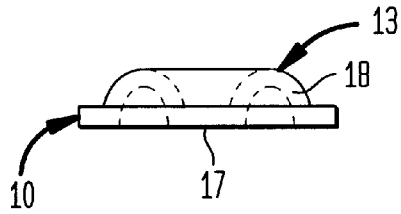
FIG. 4 is a right end view of the bimetallic actuator shown in FIG. 1.
Figure 5:
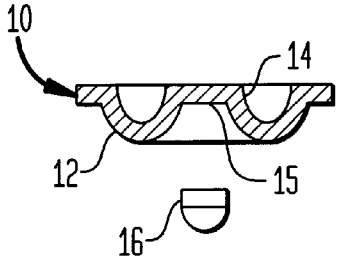
FIG. 5 is a cross-section taken on line 5—5 of FIG. 1 and showing diagrammatically a contact relative the point for the contact to be affixed.
Figure 6:
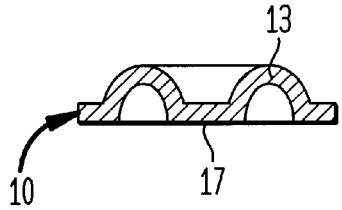
FIG. 6 is a cross-section taken on line 6—6 of FIG. 1.
Figure 7:
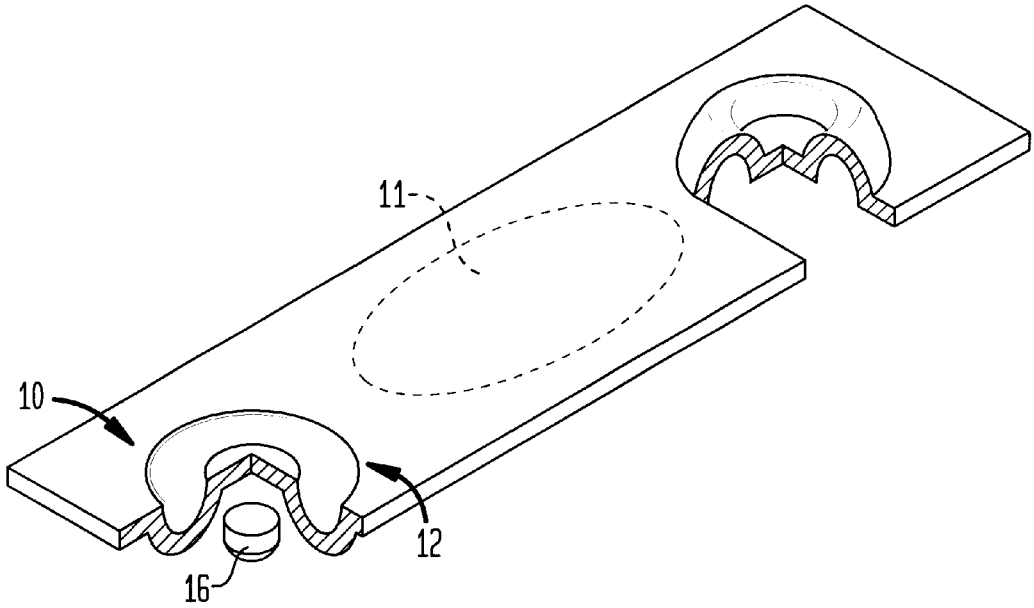
FIG. 7 is an enlarged perspective view partly in vertical section of the bimetallic actuator shown in FIG. 1 showing diagrammatically a contact relative the point for the contact to be affixed.

Referring to the drawings, FIGS. 1–7 show an enlarged view of one embodiment of bimetallic actuator in accordance with the present invention generally designated 10 generally rectangular in plan view with the calibrated area shown in dashed lines at 11. While the bimetallic actuator 10 is shown as generally rectangular in plan view for this embodiment of the present invention, it will be clear from the further embodiments hereinafter illustrated that the bimetallic actuator 10 can take other and different shapes, sizes and thickness which may be mandated for particular applications and uses for a given type of bimetallic actuated electronic component or other device such as a miniature bimetallic actuated circuit breaker, without departing from the spirit and scope of the present invention.

Further, it is also well known in the art that by selecting a material of a predetermined electrical resistance and/or thickness, each given bimetallic actuator, or a plurality of given bimetallic actuators, can be calibrated to operate at different amperages or temperature settings. Thus, different settings can be established at which the given bimetallic actuator will operate. Such bimetallic actuators are generally of the snap-acting type or the cantilevered type and are inexpensive and easy to produce or manufacture, the differential settings which cause a given bimetallic actuator to snap does not allow for an accurate temperature or current trip point, or an off time or reset setting for a given electronic component or other device utilizing such bimetallic actuator. Further, a cantilevered bimetallic actuator loses contact pressure as it approaches the trip point. Thus, in prior art electronic components or other devices utilizing cantilevered type bimetallic actuators, at low current overloads the coacting movable contacts will barely open and will immediately return to closed position which causes arcing and possibly welding at the points where coacting contacts meet, a dangerous condition because the circuit breaker or other electronic component utilizing the bimetallic plate or actuator can no longer function. Under such continuing overload conditions not only will there be excessive heating but also the possibility of fire.

Thus, maintaining the calibration for a given bimetallic actuator at the predetermined operating temperature, within the tolerances for a given electronic component or other device utilizing such bimetallic actuator, is important to the marketability of such components or devices in the commercial marketplace. This is very difficult because of the change in the calibration characteristics for a given bimetallic actuator which can occur when fixing or connecting the bimetallic actuator into assembled position or when affixing a contact on the bimetallic actuator.

In the present invention, this problem is overcome by so designing the areas which define either or both of the points or locations where the coacting contact is affixed to the bimetallic actuator or the mounting area for affixing the bimetallic actuator into assembled position in the electronic component or other device that the area becomes inert and stress forces will not be transferred into the calibrated areas of the bimetallic actuator during manufacture and assembly of the electronic component or other device.

Now referring further to FIG. 1, the bimetallic actuator 10 illustrated is provided with the center area 11 where the bimetallic actuator is calibrated. The calibrating of a bimetallic actuator is well known in the art and therefor will not be more fully described. Bimetallic actuator 10 is also shown with two contoured areas as at 12 and 13 which are disposed on opposite sides of the calibrated area 11. These two areas are provided for purposes of illustrating the present invention because one of the contoured areas as at 12 is recessed and the other contoured area is raised to show that the contoured areas can take these and other forms to render these areas or any areas on the bimetallic actuator where it is needed, inert, to prevent the transfer of force stresses from these areas to the adjacent calibrated area of the bimetallic actuator.

Figure 8:
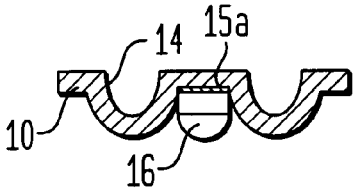
FIG. 8 is a cross-section at the contoured area about the point where the contact will be connected showing the contact welded into assembled position on the bimetallic actuator.
Figure 9:
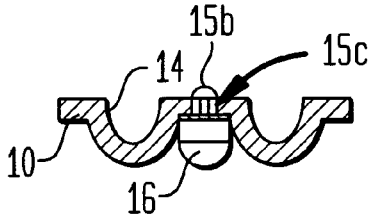
FIG. 9 is a cross-section at the contoured area about the point where the contact will be connected showing the contact riveted into assembled position on the bimetallic actuator.
Figure 10:
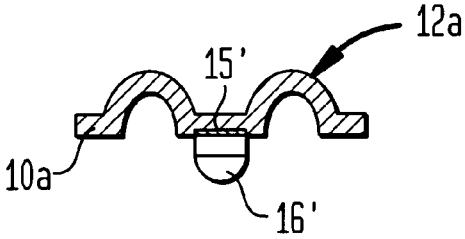
FIG. 10 is a cross-section showing an alternate embodiment for the contoured area about the point where the contact will be connected showing the contact welded into assembled position on the bimetallic actuator.
Figure 11:
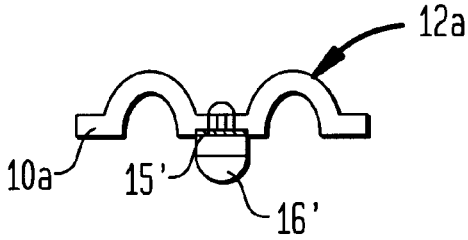
FIG. 11 is a fragmentary cross-section showing an alternate embodiment for the contoured area about the point where the contact will be connected showing the contact riveted into assembled position on the bimetallic actuator.

Thus, on one side of the calibrated area 11, the first contoured area 12 is formed by drawing, stamping or molding, as a generally annular depression or recess as at 14 about the point 15, where the contact 16 will be connected to the bimetallic actuator. The contact 16 can be welded to the point 15 as shown at 15*a* in FIG. 8 or riveted as at 15*b* through a suitable opening 15*c* formed at the point 15 on the bimetallic actuator as shown in FIG. 9 or connected by other suitable means to fix the contact 16 in assembled position. While the contoured area 12 is shown as an annular depression or recess about the point where the contact will be affixed, the contoured area alternatively as shown in FIGS. 10 and 11 may be formed as a generally annular raised area as at 12*a* about the point 15' on the bimetallic actuator 10*a* and the contact 16' welded, riveted or otherwise affixed in assembled position in the same way as shown and described for the embodiment shown in FIGS. 8 and 9.

Similarly, on the opposite side of the calibrated section 11 at the point 17 where the bimetallic actuator will be affixed to an associated bimetallic actuated electronic component or other device, contour area 13 is formed about point or locations 17 as by drawing, stamping or molding as a raised area 18. As illustrated and above described with respect to the point where the contact is affixed to the bimetallic actuator while the contoured area is shown as depressed or recessed, this area may also be depressed or recessed without departing from the scope, object and purposes of the present invention.

Further, while contoured areas are shown about both the point where the contact is affixed to the bimetallic actuator and the point where the bimetallic actuator is affixed in assembled position on an associated electronic component, it is not necessary that the bimetallic actuator have both contoured areas on either side of the calibrated area 11 and either of these areas may be eliminated for a given bimetallic actuator depending on the need, purpose and object for use of a given bimetallic actuator where during manufacture and assembly it is necessary to protect the calibration for the given bimetallic actuator.

Figure 12A:
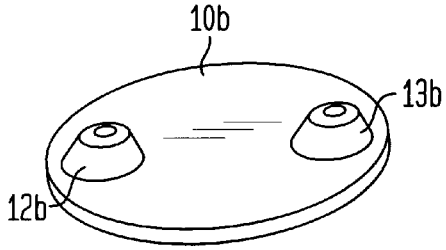
FIGS. 12A and 12B show an oval form of the bimetallic actuator in accordance with the present invention.
Figure 12B:
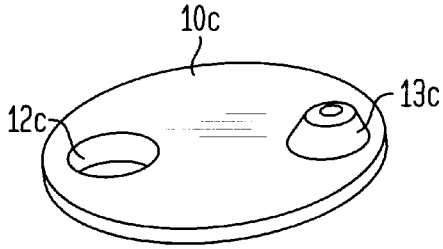
Figure 13A:
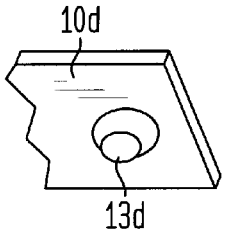
FIG. 13A shows a circular recess type connecting means for the bimetallic actuator.
Figure 13B:
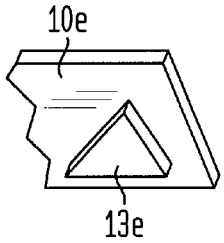
FIG. 13B shows a triangular recess type connecting means for a bimetallic actuator.
Figure 13C:
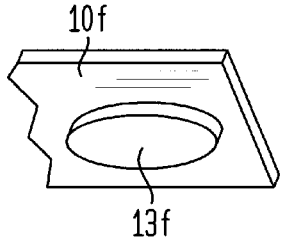
FIG. 13C shows an oval recess type connecting means for the bimetallic actuator.
Figure 13D:
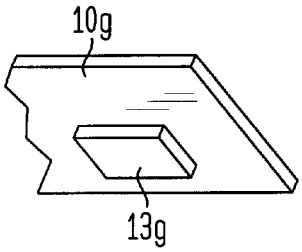
FIG. 13D shows a square recess type connecting means for the bimetallic actuator.
Figure 13E:
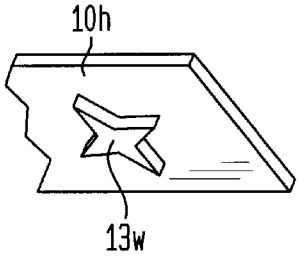
FIG. 13E shows a star recess type connecting means for the bimetallic actuator.
Figure 13F:
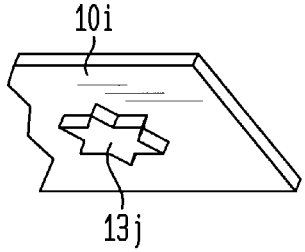
FIG. 13F shows a diamond recess type connecting means for the bimetallic actuator.
Figure 14:
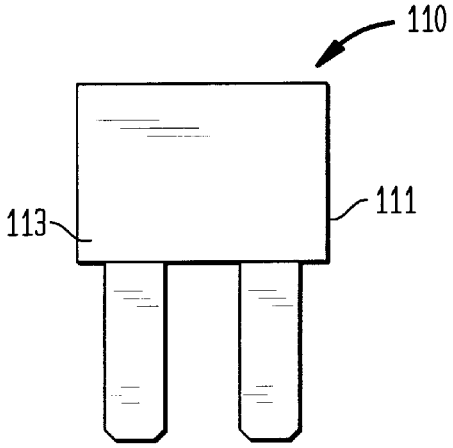
FIG. 14 is a front view of the housing for a cycling type miniature bimetallic actuated circuit breaker having a bimetallic actuator in accordance with the present invention.
Figure 15:
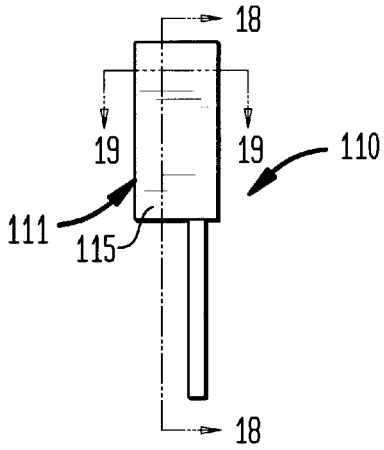
FIG. 15 is a side view of the housing for the cycling miniature bimetallic actuated circuit breaker shown in FIG. 14.
Figure 16:
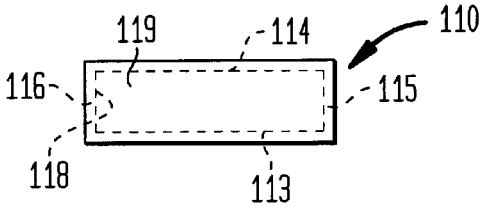
FIG. 16 is a top plan view of the housing for the cycling miniature bimetallic actuated circuit breaker shown in FIGS. 14 and 15.
Figure 17:
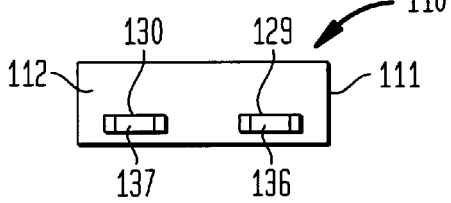
FIG. 17 is a bottom plan view of the housing for the cycling miniature bimetallic actuated circuit breaker shown in FIGS. 14, 15 and 16.

FIGS. 12A and 12B show oval forms of a bimetallic actuator as at 10*b* and 10*c* in accordance with the present invention. Bimetallic actuator lob has raised annular tapered sections as at 12*b* and 13*b*. Similarly, in FIG. 12B the bimetallic actuator has one contour area 12*c* which is depressed or recessed, and the other contoured area 13*b* raised and tapered as at 13*c*.

FIGS. 13A, 13B, 13C, 13D, 13E and 13F illustrate that the sized and shaped raised or recessed annular contoured areas can be ball shaped 13*d*, triangularly shaped 13*e*, oval shaped 13*f*, square shaped 13*g*, diamond shaped 13*h* and star shaped 13*i* to show the versatility of the connecting means for connecting the bimetallic actuator 10*d*, 10*e*, 10*f*, log, 10*h* and 10*i* into assembled position.

FIGS. 14 to 22 illustrate a cycling type miniature bimetallic actuated circuit breaker generally designated 110 having a bimetallic actuator 141 in accordance with the present invention. While a cycling type miniature bimetallic circuit breaker is used to illustrate the present invention, those skilled in the art will recognize that the present invention is equally applicable to non-cycling and manually resettable miniature bimetallic circuit breakers.

Cycling type miniature bimetallic actuated circuit breaker 110 has a generally box-shaped casing 111 with a bottom wall 112 generally rectangular in plan view, a front side wall 113 and a back side wall 114, a right end wall 115 and left end wall 116 so connected that they are held in spaced relation on the respective opposite sides and ends of the bottom wall 112 to define a chamber or space 117 generally closed at the bottom end and open at the opposite or top end as at 118 for receiving the operating elements for circuit breaker 110. A top or closure member 119 is provided to close the open top end 118 of the element chamber or space 117 after the operating elements of the miniature bimetallic actuated circuit breaker 110 have been assembled in the chamber or space 117 to effectively seal the elements in the casing 111.

The casing 111 is molded or formed from any suitable type of plastic material adapted to meet the physical handling, operating conditions and requirements for circuit breakers in accordance with the present invention for the uses and purposes as herein disclosed.

Further, while a generally rectangular box-like shape is illustrated, those skilled in the art will also recognize that the casing can have other shapes as may be desirable for a particular application for the miniature bimetallic circuit breaker without departing from the scope of the present invention.

Since a generally unitary form of the casing is above described, it will be apparent that, with this preferred type of casing for the miniature bimetallic actuated circuit breakers in accordance with the present invention, the inner surfaces of the casing must be so formed that the operatively associated elements can be loaded and assembled through the top opening 118 before the top or cover 119 is connected and sealed to close the open end of the element chamber or space 117.

As will be clear from the description that follows, the operatively associated elements are shaped and sized to fit through the single end opening 118 into the custom designed chamber or space 117 in the casing 111 for these elements. Thus, the miniature bimetallic actuated circuit breaker in accordance with the present invention, similar to the existing methods and arrangements for assembling the larger prior art types of circuit breakers, is adapted for automated insertion during assembly and fabrication of such miniature bimetallic circuit breakers.

Figure 18:
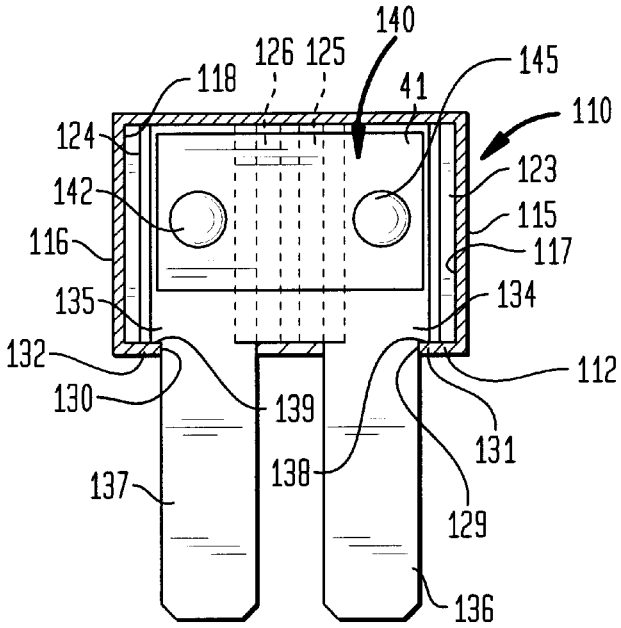
FIG. 18 is an enlarged vertical cross-section taken on line 18—18 of FIG. 15.
Figure 19:
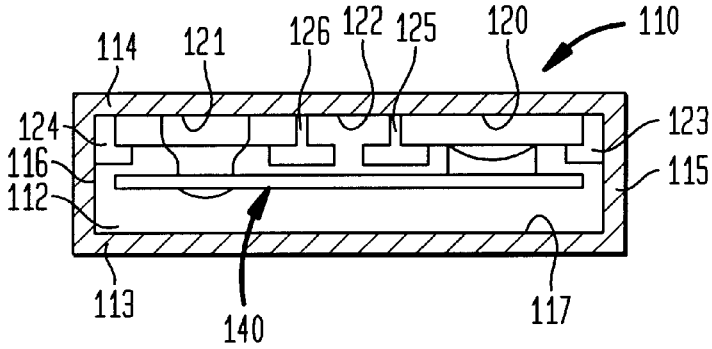
FIG. 19 is an enlarged horizontal cross-section taken on line 19—19 of FIG. 15.
Figure 20:
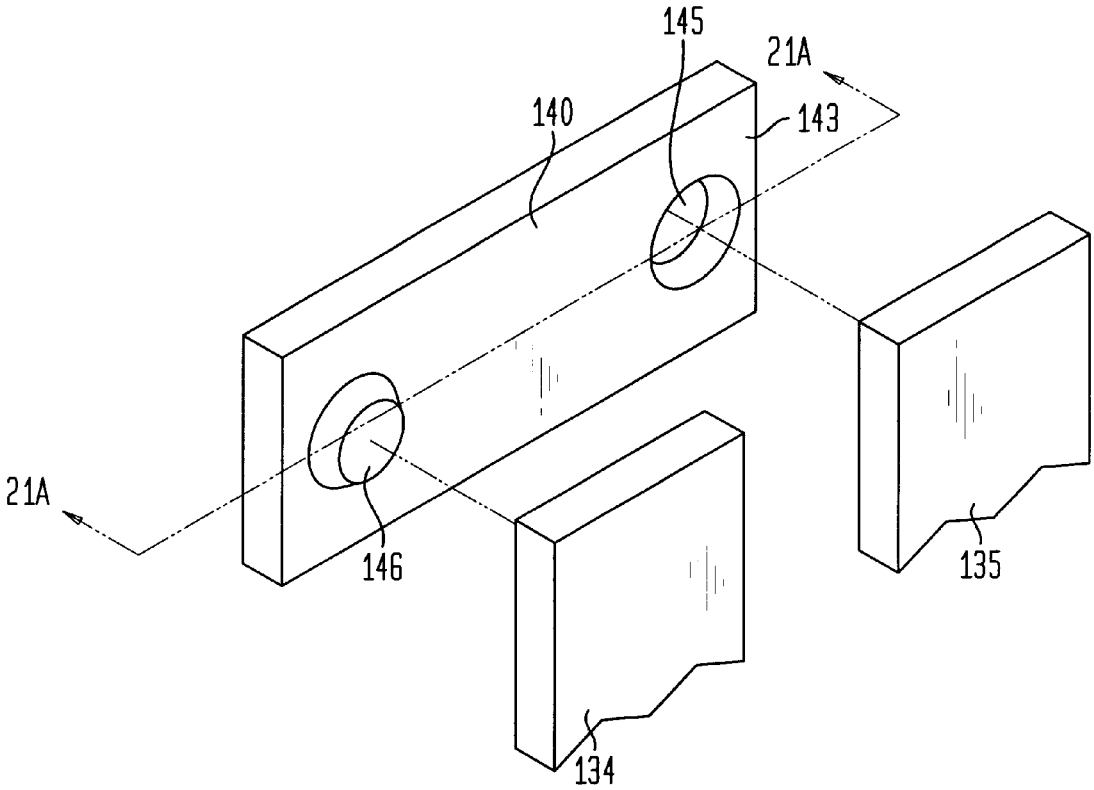
FIG. 20 is an enlarged fragmentary exploded view of the inner ends of the spaced terminals and one form of the bimetallic actuator for the cycling miniature bimetallic circuit breaker shown in FIGS. 15, 18 and 19.
Figure 22:
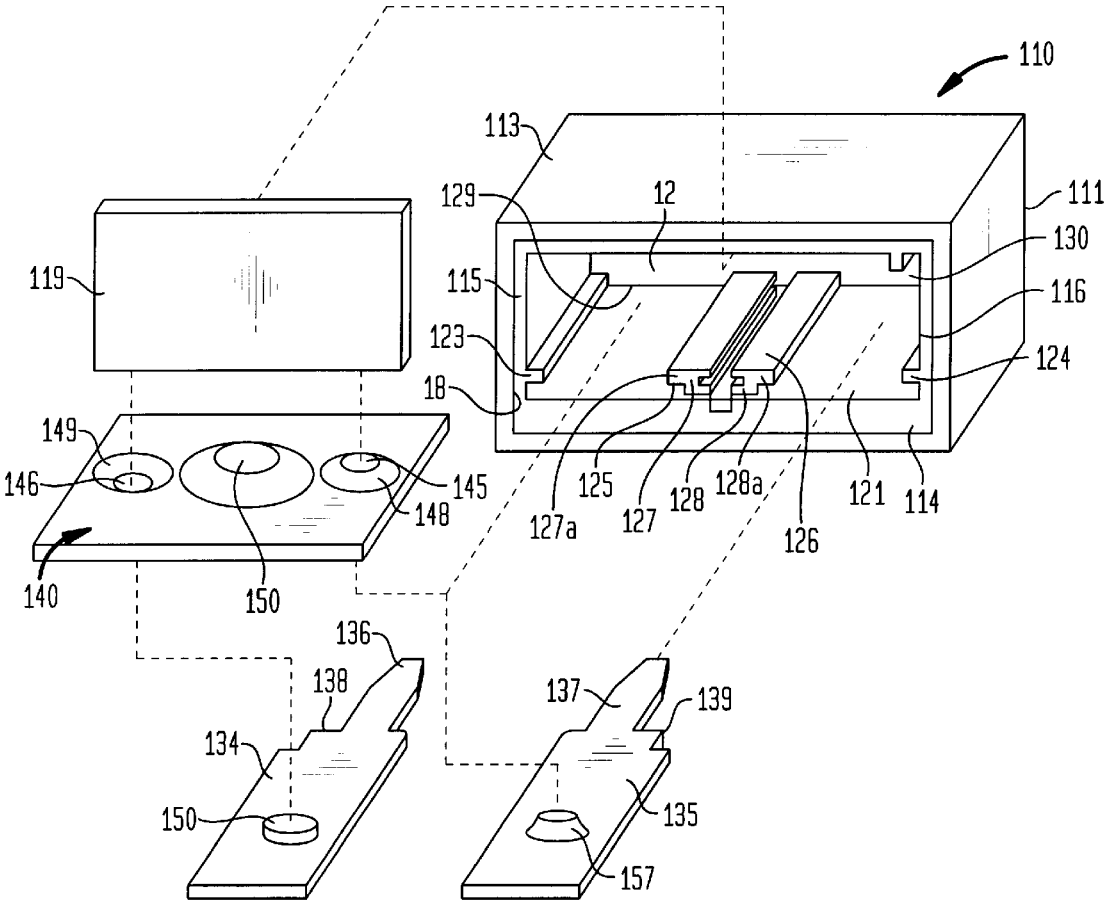
FIG. 22 is an enlarged exploded view of the cycling miniature bimetallic circuit breaker shown in FIGS. 18, 19, 20, 21A and 22B.

FIGS. 18, 19 and 22 show that the inner surfaces respectively of the back side wall 114, the right end wall 115 and left end wall 116 are formed to provide spaced longitudinally extending mounting grooves 120, 121 and 122 disposed respectively parallel to each other and to the general longitudinal line of the casing 111 of circuit breaker 110. Mounting grooves 120 and 121 are formed by longitudinally disposed and inwardly extending projections as at 123 on the respective right end wall 115 and 124 on the left end wall 116. Each projection 123 and 124 is disposed a predetermined spaced distance from the back side wall 114 to coact with a first spaced longitudinally extending generally T-shaped member 125 and a second spaced longitudinally extending generally T-shaped member 126 which are mounted to project from the inner surface of the back side wall 114 so that in assembled position one side 127*a* of the cross-bar 127 on T-shaped member 125 and one side 128*a* of the cross-bar 128 of the T-shaped member 126 are disposed to face and align with the respective inwardly extending projections 123 and 124 to define the respective mounting grooves as at 120 and 121, all of which is shown in FIGS. 18, 19 and 22 of the drawings.

In alignment with each of the respective mounting grooves 120 and 121 are spaced slots 129 and 130 in the bottom wall 112. The spaced slots 129 and 130 are narrower in width than the respective mounting grooves 120 and 121 to form stops as at 131 and 132 on the inner face of the bottom wall 112 adjacent to the respective mounting grooves 120 and 121.

Elongated, sized and shaped generally planar metallic first and second current carrying members 134 and 135 are mounted in the respective mounting grooves 120 and 121 so that a sized portion of each of the respective planar members extends through the associated slots 129 and 130 in the bottom wall 112 to the exterior of the casing 111 to form a first terminal 136 and second terminal 137 for connecting the circuit breaker 110 into any suitable type of conventional receptacle, not shown, in the associated current carrying circuit, also not shown, being protected against current overload by the circuit breaker 110.

The elongated planar first current carrying member 134 is shaped to provide a first shoulder 138 at an intermediate position disposed in assembled position in the mounting groove 120 so that the first shoulder 138 will engage the first stop 131 formed by the inner surface of the bottom wall 112 about the first slot 129 to control the length of the first terminal 136 extending from the casing 111. Similarly, the elongated second current carrying member 135 will be shaped to provide a second shoulder 139 at an intermediate position disposed in assembled position in the mounting groove 121 SO that the second shoulder 139 will engage the second stop 132 formed by the inner surface of the bottom wall 112 about the second slot 130 to control the length of the second terminal 137 extending from the casing 111.

Medially along the front face of those portions of the elongated planar first current carrying member 134 disposed in the mounting groove 120 and second current carrying member 135 disposed in mounting groove 121 a bimetallic actuator generally designated 140 in accordance with the present invention is connected for operative association with the first current carrying member 134 and second current carrying member 135 all of which is shown in FIGS. 18, 19, 20, 21A, 21B and 22 of the drawings.

FIGS. 18, 19, 20 and 22 show in this embodiment of the present invention that the bimetallic actuator 140 is generally rectangular in plan view, the same as that shown at FIGS. 1 to 7 of the drawings. It is once again noted that the bimetallic plate or actuator 140 can take other and different shapes, sizes and thickness which may be mandated for particular applications and uses for a given type of miniature bimetallic actuated circuit breaker or other electronic unit without departing from the scope of the present invention.

Such bimetallic actuator 140 has one end as at 141 fixedly connected as by welding, riveting or other means to the section of the second current carrying member 135 disposed in the casing 111 so that the end 142 opposite from the connected end is disposed for movement into and out of contact with a contact area 143 on the first current conducting member 134. A coacting movable contact 144 is connected or affixed on the end 142 of the bimetallic actuator 140, all of which is shown in FIGS. 18, 19, 20, 21A, 21B and 22 of the drawings.

This is accomplished at either the mounting or fastening point 145 for the bimetallic actuator 140 or the connecting point 146 thereon for the movable contact 144 by sized and shaped contoured areas as at 148 and 149 on the bimetallic actuator 40 which respectively lie between the adjacent edge and on opposite sides of the calibration section 150 for the bimetallic actuator 50. In this regard, note that the sized and shaped contoured areas as at 148 and 149 are inwardly of and do not extend over or off the adjacent edge of the bimetallic actuator 140. These sized and shaped contoured areas 148 and 149 coact with corresponding sized and shaped protuberance as at 151 on the second current carrying member 135 and the sized and shaped stationary contact 152 on the first current carrying member 134.

Figure 21A:
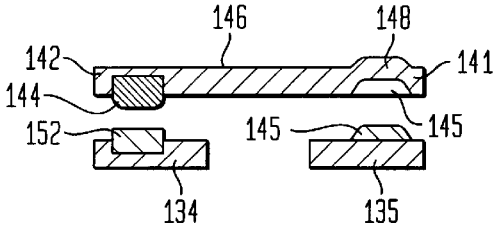
FIG. 21A is an enlarged cross-section showing the bimetallic actuator and the inner ends of the respective spaced current carrying members shown in FIGS. 18, 19 and 20 of these drawings before they are connected in assembled position.
Figure 21B:
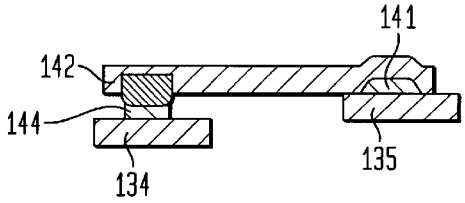
FIG. 21B is the same enlarged cross-section as shown in FIG. 21A after the bimetallic actuator is connected in assembled position to permit operative coaction of the movable contact, on the end of the bimetallic actuator remote from the connected end, with the stationary contact on the inner end of the associated first contact carrying member.

Since the sized and shaped contoured areas are generally annular and located within the side edges of the bimetallic actuator 140 and do not run off the edge, they produce stress resistant mounting locations which allow for attitude adjustment of the bimetallic actuator relative the protuberance 151 on the second current carrying member 137 as shown in FIGS. 21A and 22B of the drawings which show how the sized and shaped contoured area 148 on the bimetallic actuator can be pivoted relative the protuberance 157. Since different forms and materials for a given bimetallic plate are required to meet various temperature ranges or current sensing conditions or characteristics for a given miniature bimetallic actuated circuit breaker or the like electronic components, this construction is necessary to provide a uniform yet adjustable means for accurate, repeatable counter pressure to the movable contact end of the bimetallic plate. Further, this connecting assembly also acts to accurately pilot the bimetallic actuator 140 into assembled position and provides a more flexible and stress resistant mounting location when the bimetallic actuator 140 is assembled for cantilevered operation. This mounting location and connecting assembly, being more flexible and stress resistant, will be less likely to fatigue or fail even when slight tacking of the stationary contact 152 and movable contact 144 occurs during adverse operating conditions.

While the foregoing description of the illustrated figures of the drawings are directed to the preferred embodiments of the improved bimetallic actuator and to the use thereof for achieving miniature circuit breakers, all in accordance with the present invention, those skilled in the art will appreciate that numerous modifications can be made to the various aspects of these illustrated embodiments. Indeed, such modifications are encouraged by the description to be made in the materials, structure and arrangements of the disclosed embodiments without departing from the spirit and scope thereof.

Thus, the foregoing description of such preferred embodiments should be taken by way of illustration rather than by way of limitation with respect to the present invention which is defined by the appended claims.

What is claimed is:

1. A calibrated bimetallic actuator for electronic components and other devices comprising:

a. at least one location for affixing the bimetallic actuator in assembled position; and b. a contoured area formed about each location having a generally annular shape to restrict transfer of force stresses during manufacture and assembly of the bimetallic actuator into assembled position to prevent loss of calibration for said bimetallic actuator.

2. A calibrated bimetallic actuator for electronic components and other devices comprising:

a. at least one location for affixing a contact on the bimetallic actuator;

b. a contour area formed about the location for the contact having a generally annular shape to restrict transfer of force stresses from the location where the contact is affixed on the bimetallic actuator to prevent loss of calibration for said bimetallic actuator.

3. A calibrated bimetallic actuator for electronic components and other devices comprising:

a. at least one location for affixing the bimetallic actuator in assembled position;

b. at least one location for affixing a contact on the bimetallic actuator; and c. contour areas having a generally annular shape formed about at least one of the said locations to restrict transfer of force stresses from said at least one location to prevent loss of calibration of the bimetallic actuator.

4. A calibrated bimetallic actuator for an electronic component having, a housing, a first current carrying member and a second current carrying member, said bimetallic actuator comprising:

a. a mounting location for fixedly connecting said bimetallic actuator to said first current carrying member, and a first contoured area about the mounting location for the bimetallic actuator;

b. contact means on said bimetallic actuator and a second contoured area about the contact means;

c. said contact means in assembled position disposed for operative engagement with said second current carrying member; and d. said contoured areas having annular shape to restrict transfer of force stresses during manufacture and assembly of the bimetallic actuator to prevent loss of calibration of said bimetallic actuator.

5. In the bimetallic actuator as in claim 4 wherein the first contoured area and second contoured area are formed inwardly of the side walls of the bimetallic actuator.

6. In the bimetallic actuator as in claims 4 or 5 wherein the first contoured area and second contoured area respectively have generally annular shape.

7. In the bimetallic actuator as in claims 4, 5 or 6 wherein the first contoured area and second contoured area respectively have the same generally annular geometric shape.

8. In the bimetallic actuator as in claims 4, 5 or 6 wherein the first contoured area and second contoured area respectively have different generally annular geometric shapes.

9. A calibrated bimetallic actuator for an electronic component having, a housing, a first current carrying member and a second current carrying member comprising, a first generally annular recessed area about a first mounting location for connecting the bimetallic actuator onto said first current carrying member, and a second generally annular recessed area remote from said first annular recessed area on the bimetallic actuator, and a contact means affixed in said second annular recessed area of the bimetallic actuator for operative engagement with said second current carrying member during operation of said electronic component.

10. In the bimetallic actuator as in claim 9 wherein the first annular recessed area and second annular recessed area are inwardly of all side edges of the bimetallic actuator.

11. In the bimetallic actuator as in claims 9 or 10 wherein said first annular recessed area has a first random shape, and the second annular recessed area has the same random shape as the first annular recessed area.

12. In the bimetallic actuator as in claims 9 or 10 wherein said first annular recessed area has a first random shape, and the second annular recessed area has a different random shape from that of the first annular and recessed area.

13. In the bimetallic actuator as in claims 9 or 10 wherein said first annular recessed area and said second annular recessed area respectively have the same geometric shape.

14. In the bimetallic actuator as in claims 9 or 10 wherein said first annular recessed area has a first geometric shape and said second annular recessed area has a different geometric shape from that of said first annular recessed area.

15. In the bimetallic actuator as in claims 9 or 11, wherein said first annular recessed area and said second annular recessed area are respectively circular.

16. In the bimetallic actuator as in claims 9 or 11 wherein said first annular recessed and said second annular recessed area are respectively square.

17. In the bimetallic actuator as in claims 9 or 11, wherein said first annular recessed area and said second annular recessed area are respectively oval.

18. In the bimetallic actuator as in claims 9 or 11, wherein said first annular recessed area and said second annular recessed area are respectively triangular.

19. In the bimetallic actuator as in claims 9 or 11 wherein said first annular recessed area and said second annular recessed area are respectively rectangular.

20. In the bimetallic actuator as in claims 9 or 11, wherein said first annular recessed area and said second annular recessed area are respectively star shaped.

* * * * *

UNITED STATES PATENT AND TRADEMARK OFFICE

CERTIFICATE OF CORRECTION

PATENT NO. : 6,552,645 B2
DATED : April 22, 2003
INVENTOR(S) : Robert A. Kuczynski It is certified that error appears in the above-identified patent and that said Letters Patent is hereby corrected as shown below:

Column 7,
Line 67, "lob" should read -- 10b --.

Column 9,
Line 50, "SO" should read -- so --.

Column 12,
Lines 37, 40, 43, 46, 49 and 52, "11" should read -- 10 --.

Signed and Sealed this

Second Day of September, 2003

JAMES E. ROGAN
*Director of the United States Patent and Trademark Office*